US005516165A

United States Patent [19]

Yamada

[11] Patent Number: 5,516,165

[45] Date of Patent: May 14, 1996

[54] DOOR LOCKING HANDLE ASSEMBLY

[75] Inventor: Kenichi Yamada, Tokyo, Japan

[73] Assignee: Takigen Manufacturing Co. Ltd., Tokyo, Japan

[21] Appl. No.: 265,673

[22] Filed: Jun. 24, 1994

[30] Foreign Application Priority Data

Oct. 7, 1993 [JP] Japan ..... 5-276039

[51] Int. Cl.[6] ..... E05B 3/04

[52] U.S. Cl. ..... 292/210; 292/336; 292/336.3; 292/DIG. 31

[58] Field of Search ..... 292/DIG. 31, 210, 292/336.3, 336; 70/208

[56] References Cited

U.S. PATENT DOCUMENTS

| | | | |
|---|---|---|---|
| 2,186,795 | 1/1940 | Anderson | 292/DIG. 49 X |
| 2,653,842 | 9/1953 | Love | 292/DIG. 31 X |
| 3,240,523 | 3/1966 | Heimann | 292/210 X |
| 4,134,281 | 1/1979 | Pelcin | 292/210 X |
| 4,268,077 | 5/1981 | Bohleen et al. | 292/210 X |
| 4,365,831 | 12/1982 | Bourne | 292/210 X |
| 4,510,779 | 4/1985 | Ahad | 70/208 |
| 4,638,649 | 1/1987 | Chao | 292/DIG. 31 X |
| 5,469,725 | 11/1995 | Yamada | 70/208 |

FOREIGN PATENT DOCUMENTS

| | | | |
|---|---|---|---|
| 491774 | 3/1953 | Canada | 292/DIG. 31 |
| 2669961 | 6/1992 | France | 292/DIG. 31 |
| 728395 | 11/1942 | Germany | 70/75 |
| 776059 | 6/1957 | United Kingdom | 292/DIG. 31 |
| 1575252 | 9/1980 | United Kingdom | 292/DIG. 31 |

*Primary Examiner*—Lloyd A. Gall
*Attorney, Agent, or Firm*—Martin Smolowitz

[57] ABSTRACT

A door locking handle assembly in which: a pivot 13 through which a button 7 is pivoted to a casing 1 is prevented from deflecting to ensure a smooth swinging action of the button 7; a leg 8 of the button 7 extends from a rear surface of the button 7 and has a hole 9 through which the pivot 13 passes; the pivot 13 also passes a hole 12 of a bearing portion 11 of a base plate 10 of a button unit 6, so that the button 7 is pivoted to the base plate 10 through the pivot 13 and biased forward by a spring 14; and, the unit 6 is received in a lower space 15 of the casing 1, and has the base plate 10 fixed to a bottom wall 4 of the casing 1 and has opposite ends of the pivot 13 abut on inner surfaces of side wall portions 5 of the casing 1 to prevent the pivot 13 from dropping from the unit 6.

3 Claims, 3 Drawing Sheets

DOOR LOCKING HANDLE ASSEMBLY

BACKGROUND OF THE INVENTION

1. Field of the Invention

The present invention relates to a door locking handle assembly for use on a plugboard box and the like.

2. Description of the Prior Art

As shown in FIG. 7, in a conventional door locking handle assembly: an extensible and retractable handle piece 22 is pivoted to a casing 21 through a first cross pivot 23 which is received therein; a driving projection element 24 is mounted on a rear surface of the handle piece 22; a passage hole 26, through which the driving projection element 24 extends rearward, is provided in a bottom wall 25 of the casing 21; and, a button member 27 is pivoted to a lower portion of the casing 21 through a second cross pivot 28 and biased forward by a spring 29.

Each of the above-mentioned cross pivots has its opposite ends staked when it is mounted on the casing 21. The first cross pivot 23 through which the handle piece 22 is pivoted to the casing 21 is large in diameter, while the second cross pivot 28 through which the button member 27 is pivoted to the casing 21 is small in diameter. Consequently, when the opposite ends of the large-diameter first cross pivot 23 are axially pressed so as to be staked to the casing 21 the small-diameter second cross pivot 28 often buckles so as to prevent the button member 27 from smoothly operating.

SUMMARY OF THE INVENTION

It is an object of the present invention to provide a door locking handle assembly in which a second cross pivot through which a button member is pivoted to a casing of the assembly is prevented from deflecting to ensure a smooth swinging action of the button member.

The above object of the present invention is accomplished by providing:

In a door locking handle assembly comprising a handle piece which is extensibly and retractably received in a base-end portion of a casing and pivoted to the casing through a first cross pivot, the handle piece being adapted to be held in its retracted position within the casing by a button member mounted in the casing, the improvement wherein:

the button member is provided with a leg plate portion extending from a rear surface of the button member, the leg portion being provided with an axial hole;

a base plate of a button unit is provided with a bearing plate portion extending from a front surface of the base plate, the bearing plate portion being provided with an axial hole;

a second cross pivot passes through these axial holes so that the button member is pivoted to the base plate through the second cross pivot and biased forward by a spring;

the button unit is constructed of the button member, the second cross pivot, the spring and the base plate;

the casing is provided with a space in its lower portion, the space being adapted to receive the button unit therein; and, the button unit is received in the space of the casing so as to have: the button member disposed forward; the base plate fixed to a bottom wall of the casing; and, opposite ends of the second cross pivot abut on inner surfaces of opposite side wall plate portions of the casing to prevent the second cross pivot from dropping from the button unit.

DESCRIPTION OF THE PREFERRED EMBODIMENTS

Figure 1:
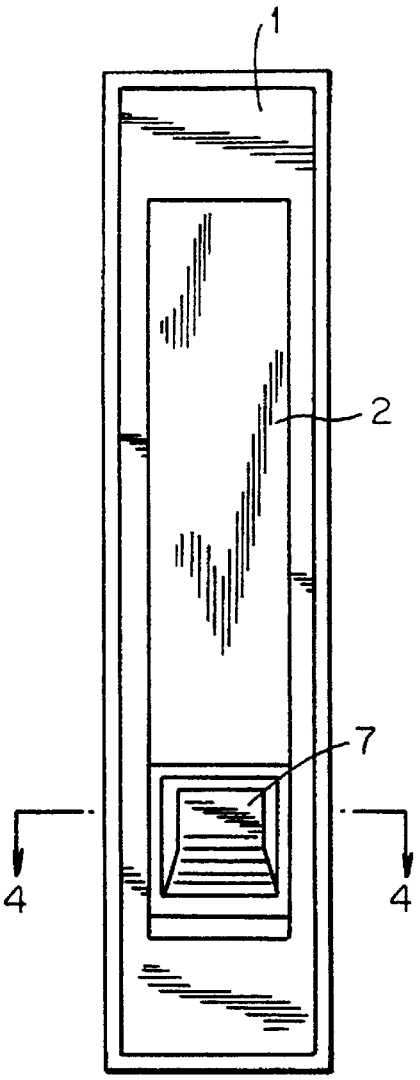
FIG. 1 is a front view of an embodiment of the door locking handle assembly of the present invention.
Figure 2:
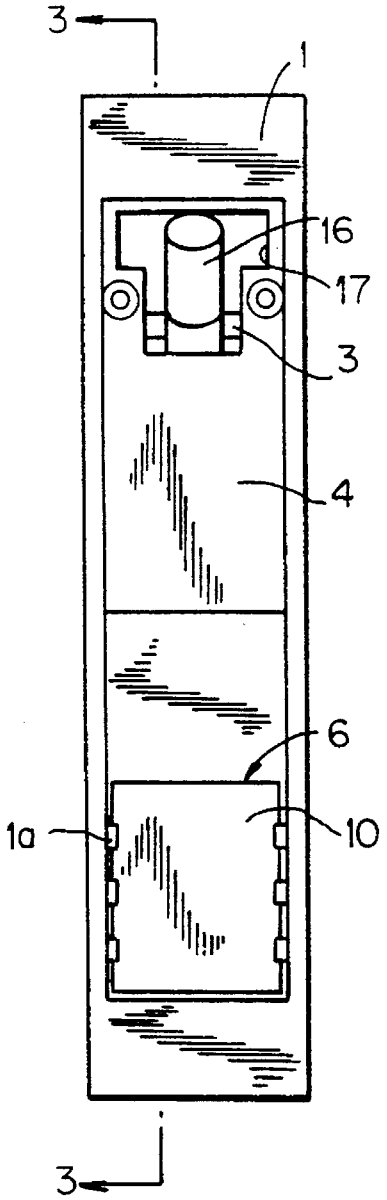
FIG. 2 is a rear view of the door locking handle assembly of the present invention shown in FIG. 1.
Figure 4:
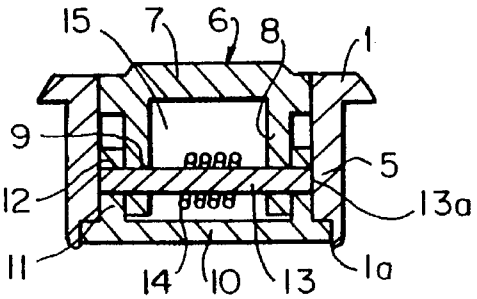
FIG. 4 is a cross-sectional view of the door locking handle assembly, taken along the line 4—4 of FIG. 1.
Figure 5:
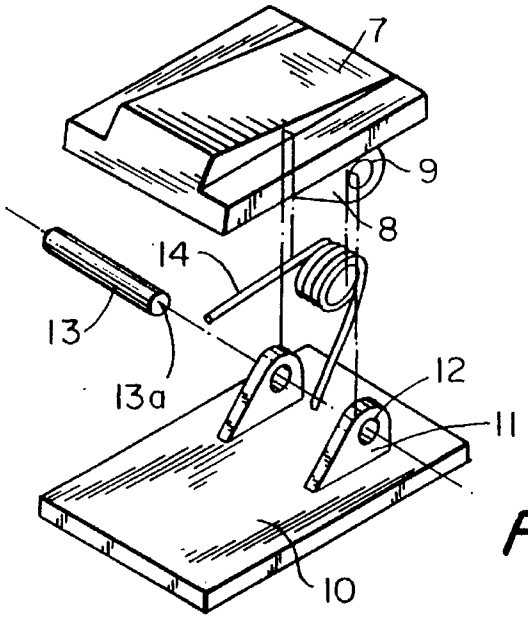
FIG. 5 is an exploded perspective view of the button unit of the door locking handle assembly of the present invention shown in FIG. 1.

Hereinbelow, the present invention will be described in detail with reference to the accompanying drawings and the reference numerals therein.

A door locking handle assembly of the present invention comprises a handle piece 2 which is extendibly and retractably received in a base-end portion of a casing 1 and pivoted to the casing 1 through a first cross pivot 3. The handle piece 2 is adapted to be held in its retracted position within the casing 1 by a button member 7 mounted in the casing 1.

Further, in the present invention, the button member 7 is provided with a leg plate portion 8 which extends from a rear surface of the button member 7. The leg plate portion 8 of the button member 7 is provided with an axial hole 9. On the other hand, a base plate 10 of a button unit 6 is provided with dual bearing plate portions 11 extending from a front surface of the base plate 10. Each bearing plate portion 11 of the base plate 10 is provided with an axial hole 12. A second cross pivot 13 passes through these axial holes 9, 12 so that the button member 7 is pivoted to the base plate 10 through the second cross pivot 13 and biased forward by a spring 14.

As is clear from the above description, the button unit 6 is constructed of the button member 7, the second cross pivot 13, the spring 14 and the base plate 10.

The casing 1 is provided with a space 15 in its lower portion. The space 15 of the casing 1 is adapted to receive the button unit 6 therein. The button unit 6 is received in the space 15 of the casing 1 so as to have: the button member 7 disposed forward; the base plate 10 fixed to a bottom wall 4 of the casing 1; and, opposite ends 13*a* of the second cross pivot 13 abut on inner surfaces of opposite side wall plate portions 5 of the casing 1 to prevent the second cross pivot 13 from dropping from the button unit 6.

Figure 3:
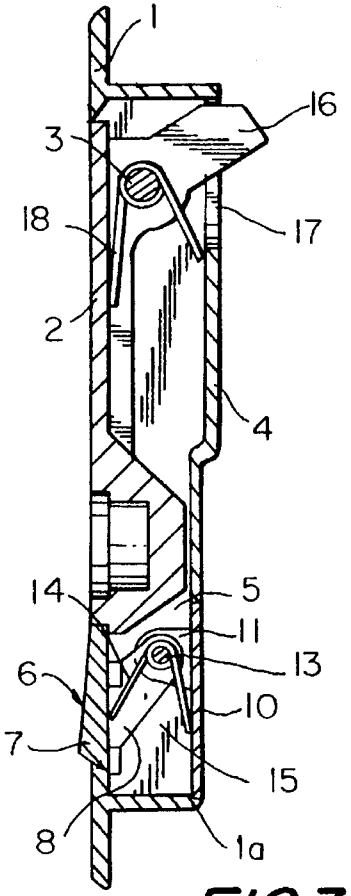
FIG. 3 is a longitudinal sectional view of the door locking handle assembly, taken along the line 3—3 of FIG. 2.
Figure 7:
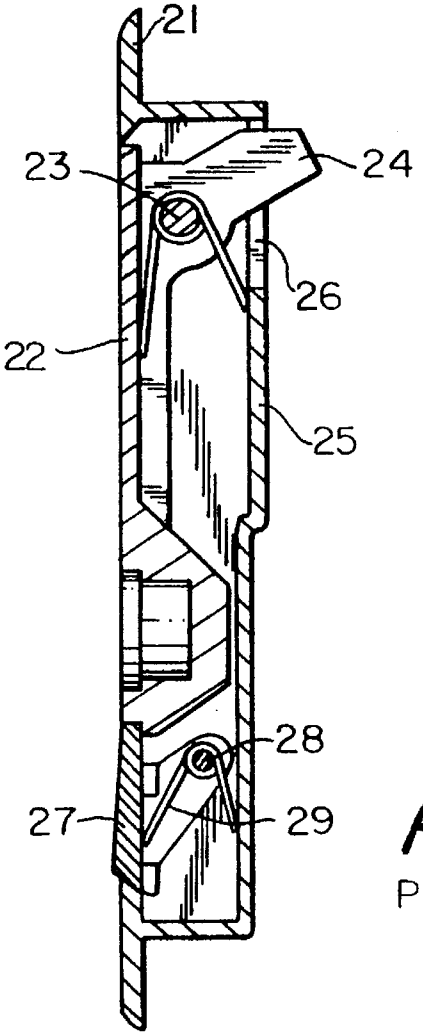
FIG. 7 PRIOR ART
FIG. 7 is a longitudinal sectional view of the conventional door locking handle assembly.

In operation, when the button member 7 is depressed in a condition shown in FIG. 3, the button member 7 swings on the second cross pivot 13 counterclockwise to permit the handle piece 2 to swing on the first cross pivot 3 clockwise, so that the handle piece 2 projects forward. The button member 7 is biased by the spring 14 forward. Consequently, when the handle piece 2 is swung counterclockwise to return to its locked position, the button member 7 automatically returns to its locked position in which the button member 7 locks the handle piece 2 to the button unit 6.

Since it is necessary for the second cross pivot 13 to pass through the axial holes 9, 12, it is also necessary for the second cross pivot 13 to have its length be equal to a width of the space 15 of the casing 1, whereby the pivot 13 has its opposite ends abut on inner surfaces of opposite side wall plate portions 5 of the casing 1 to prevent the second cross pivot 13 from axially moving relative to the casing 1. Consequently, even when the pivot 13 is not fixed to the casing 1, there is no fear that the pivot 13 drops from the axial holes 9, 12.

In the embodiment of the present invention shown in FIGS. 1 to 5, the handle piece 2 has its upper-end portion pivoted to the casing 1 through the first cross pivot 3. The cross pivot 3 has its opposite ends staked so as to be fixedly mounted in the casing 1. The handle piece 2 is biased clockwise by a coil spring 18, and is provided with a driving projection element 16 which extends from a rear surface of the handle piece 2. The driving projection element 16 of the handle piece 2 passes through a passage hole 17 of a rear surface of the casing 1 so as to be extensible and retractable relative to the casing 1, and is operated to drive a locking member (not shown).

Further, in the present invention, by inserting the second cross pivot 13 into the axial hole 9 of the push button member 7 and the axial holes 12 of the base plate 10, the button unit 6 is assembled. The button unit 6 is inserted in the space 15 of the casing 1 from the rear of the casing 1 through a rear opening of the casing 1 and mounted therein. After completion of mounting of the button unit 6 in the space 15 of the casing 1, a button-unit mounting portion 1*a* of the bottom wall 4 of the casing 1 is staked so that the button unit 6 is fixedly mounted in the casing 1.

Figure 6:
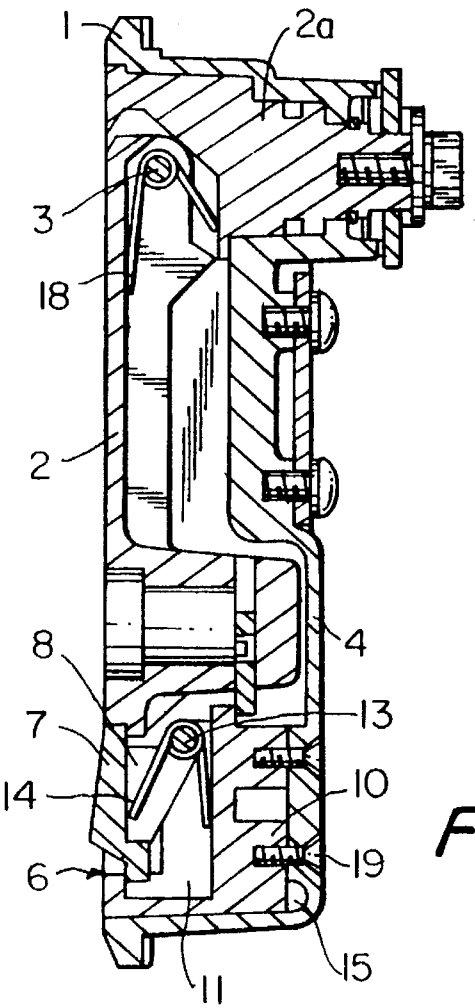
FIG. 6 is a longitudinal sectional view of the door locking handle assembly of another embodiment of the present invention.

In another embodiment of the door locking handle assembly of the present invention shown in FIG. 6, the handle piece 2 is pivoted to a locking shaft 2*a* through the first cross pivot 3. When a user wants to unlock the handle assembly, it is necessary to depress the button member 7. When the button member 7 is depressed, the handle piece 2 is permitted to swing clockwise on the first cross pivot 3 under the influence of a resilient force exerted by the spring 18. As a result, the handle piece 2 extends outward. The handle piece 2 thus extended outward is gripped by the user and laterally swung by him on the locking shaft 2*a* in a predetermined direction, so as to unlock the door locking handle assembly.

When the button unit 6 is mounted in the space 15 of the casing 1, the button unit 6 is inserted into the space 15 of the casing 1 from a front side of the space 15 so that the button member 7 is disposed forward. On the other hand, a rear surface of the base plate 10 is fixed to the bottom wall 4 of the casing 1 by fastening means such as screws 19 so that the button unit 6 is fixedly mounted in the casing 1.

In the door locking handle assembly of the present invention having the above construction: the second cross pivot 13 passes through the axial hole 9 of the leg plate portion 8 of the button member 7 and the axial hole 12 of the bearing plate portion 11 of the base plate 10, so that the button member 7 is pivoted to the base plate 10 through the second cross pivot 13 and biased forward by the spring 14; the button unit 6 is received in the space 15 of the casing 1 so as to have the button member 7 disposed forward; the base plate 10 of the button unit 6 is fixed to the bottom wall 4 of the casing 1; and, the second cross pivot 13 has its opposite ends 13*a* abut on the inner surfaces of the opposite side wall plate portions 5 of the casing 1, which eliminates the need for the staking process of the opposite ends 13*a* of the second cross pivot 13, in which staking process the pivot 13 is axially pressed; whereby there is no fear that the second cross pivot 13 buckles and deflects in assembling, which ensures the smooth swinging action of the button member 7 in operation.

What is claimed is:

1. In a door locking handle assembly comprising a handle piece (2) which is extendibly and retractably received in a base-end portion of a casing (1) and pivoted to said casing (1) through a first cross pivot (3), said handle piece (2) being adapted to be held in its retracted position within said casing (1) by a button member (7) mounted in said casing (1), the improvement wherein:

said button member (7) is provided with a leg plate portion (8) extending from a rear surface of said button member (7), said leg plate portion (8) being provided with an axial hole (9);

a base plate (10) of a button unit (6) is provided with dual bearing plate portions (11) extending from a front surface of said base plate (10), each said bearing plate portion (11) being provided with an axial hole (12);

a second cross pivot (13) which passes through said axial holes (9, 12) so that said button member (7) is pivoted to said base plate (10) through said second cross pivot (13) and biased forward by a spring (14) provided between said button member (7) and said base plate (10);

said button unit (6) being constructed of said button member (7), said second cross pivot (13), said spring (14) and said base plate (10);

said casing (1) is provided with a space (15) in its lower end portion, said space (15) being adapted to receive said button unit (6) therein; and said button unit (6) is received in said space (15) of said casing (1) so as to have said button member (7) disposed forward, said base plate (10) being fixed to a bottom wall (4) of said casing (1), and opposite ends (13*a*) of said second cross pivot (13) abut on inner surfaces, which inwardly face one another, of opposite side wall plate portions (5) of said casing (1) to prevent said second cross pivot (13) from dropping from said button unit (6).

2. The door locking handle assembly according to claim 1, wherein said base plate (10) of said button unit (6) is fixed to the bottom wall (4) of said casing (1) by fastening means.

3. In a door locking handle assembly comprising:

a handle piece (2) which is extendibly and retractably received in a base-end portion of a casing (1) and pivoted to a locking shaft (2*a*) in said casing (1) through a first cross pivot (3), said handle piece (2) being adapted to be held in its retracted position within said casing (1) by a button member (7) mounted in said casing (1), the improvement wherein:

said button member (7) is provided with a leg plate portion (8) extending from a rear surface of said button member (7), said leg plate portion (8) being provided with an axial hole (9);

a base plate (10) of a button unit (6) is provided with dual bearing plate portions (11) extending from a front surface of said base plate (10), each said bearing plate portion (11) being provided with an axial hole (12);

a second cross pivot (13) which passes through said axial holes (9, 12) so that said button member (7) is pivoted to said base plate (10) through said second cross pivot (13) and biased forward by a spring (14) provided between said button member (7) and said base plate (10);

said button unit (6) being constructed of said button member (7), said second cross pivot (13), said spring (14) and said base plate (10);

said casing (1) is provided with a space (15) in its lower end portion, said space (15) being adapted to receive said button unit (6) therein; and said button unit (6) is received in said space (15) of said casing (1) so as to have said button member (7) disposed forward, said base plate (10) being fixed to a bottom wall (4) of said casing (1), and opposite ends (13*a*) of said second cross pivot (13) abut on inner surfaces, which inwardly face one another, of opposite side wall plate portions (5) of said casing (1) to prevent said second cross pivot (13) from dropping from said button unit (6), so that when said handle piece (2) is extended outwardly it can be laterally swung in a predetermined direction so as to unlock the door locking handle assembly.

* * * * *